US007712948B2

(12) United States Patent
Schug et al.

(10) Patent No.: US 7,712,948 B2
(45) Date of Patent: May 11, 2010

(54) LIGHT-SOURCE MODULE AND HOLDER THEREFOR

(75) Inventors: Josef Schug, Wurselen (DE); Peter Linssen, Eindhoven (NL); Ralph Peters, Maastricht (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 135 days.

(21) Appl. No.: 11/815,106

(22) PCT Filed: Jan. 24, 2006

(86) PCT No.: PCT/IB2006/050249

§ 371 (c)(1),
(2), (4) Date: Jul. 31, 2007

(87) PCT Pub. No.: WO2006/082537

PCT Pub. Date: Aug. 10, 2006

(65) Prior Publication Data

US 2008/0205055 A1 Aug. 28, 2008

(30) Foreign Application Priority Data

Feb. 2, 2005 (EP) ..... 05100711

(51) Int. Cl.
*H01R 33/00* (2006.01)

(52) U.S. Cl. ..... 362/647; 362/658; 362/659; 362/549; 362/652

(58) Field of Classification Search ..... 362/647, 362/652, 655, 658–659, 249.01, 249.02, 362/548, 59, 294, 373, 65, 800
See application file for complete search history.

(56) References Cited

U.S. PATENT DOCUMENTS

| | | | | |
|---|---|---|---|---|
| 5,436,809 | A | 7/1995 | Brassier et al. | |
| 6,082,883 | A * | 7/2000 | Tatsumi et al. | 362/548 |
| 6,083,012 | A | 7/2000 | Suzuki et al. | |
| 6,357,902 | B1 | 3/2002 | Horowitz | |
| 6,558,021 | B2 | 5/2003 | Wu et al. | |
| 7,004,609 | B2 * | 2/2006 | Behr et al. | 362/549 |
| 7,150,553 | B2 * | 12/2006 | English et al. | 362/545 |
| 7,163,404 | B2 * | 1/2007 | Linssen et al. | 439/56 |
| 7,275,854 | B2 * | 10/2007 | Dorleijn et al. | 362/649 |
| 2007/0274090 | A1 * | 11/2007 | Tiesler-Wittig | 362/548 |

FOREIGN PATENT DOCUMENTS

| | | |
|---|---|---|
| DE | 2732780 | 2/1979 |
| DE | 4243175 | 6/1994 |

(Continued)

*Primary Examiner*—Thomas M Sember
(74) *Attorney, Agent, or Firm*—Thorne & Halajian, LLP

(57) ABSTRACT

A light-source module is described having at least one light-emitting element (3) such as, in particular, LEDs, light guides, collimator elements or lens elements, which together form a light exit area, as also is a holder for a module of this in the form of an LED module, system, such as in particular a motor vehicle headlight or a lighting or projecting means, that is intended to have a given light emission pattern. For this purpose, the module is able to be positioned relative to at least one reference plane of the optical system and, at the same time, is able to be replaced easily without soldered, bonded or welded connections being required.

11 Claims, 7 Drawing Sheets

FOREIGN PATENT DOCUMENTS

| | | | |
|---|---|---|---|
| DE | 29907034 | | 11/1999 |
| DE | 10053573 | A1 | 5/2002 |
| DE | 10133255 | | 1/2003 |
| EP | 434471 | A1 | 6/1991 |
| EP | 1107389 | | 6/2001 |
| WO | 9835851 | | 8/1998 |
| WO | 0159359 | | 8/2001 |

* cited by examiner

LIGHT-SOURCE MODULE AND HOLDER THEREFOR

The invention relates to a light-source module having at least one light-emitting element such as, in particular, LEDs, light guides, lens elements or a collimator aperture. The invention also relates to a holder for a module of this kind. The module, especially in the form of an LED module, is suitable for use in an optical system, such as in particular a motor vehicle headlight or a lighting or projecting means, that is intended to have a given light emission pattern.

There are various known LED modules that have one or more LED elements and a carrier to enable them to be fastened in place mechanically and to allow electrical contact to be made with them. In EP 0 434 471 for example, there is described an LED module in the form of a housing for an LED element, that is intended for surface mounting on a printed circuit board.

As well as this, there is disclosed in DE 101 33 255 an LED module having a plurality of LED elements arranged on a carrier plate, the carrier plate being intended for the electrical connection of the LED module to a lighting means and for the fastening of the LED module thereto.

A disadvantage of these and other LED modules is, in general, the fact that they are not suitable, or are suitable to only a limited degree, for applications in which on the one hand a given shape and/or alignment of the light beam emitted (the light emission pattern) has to be obtained with the greatest possible accuracy in one or more planes and in which on the other hand the module is intended to be capable of being replaced easily without any soldering, welding, bonding, or the like being required. These are requirements that are imposed by, for example, use in the headlights of motor vehicles.

It is true that lamp holders for headlights of this kind are known in which the halogen lamps usually used can be inserted relatively easily and can at the same time be correctly positioned relative to the optical axis of the headlight (and can be connected up electrically), in which case, as a rule, the optical axis points approximately in the same direction as the longitudinal axis of the vehicle. The principle of such lamp holders cannot however be applied to LED and similar elements or arrangements that are spread out in a plane, simply because these latter have a different light emission pattern (e.g. a Lambertian intensity distribution) than halogen lamps (which have an intensity distribution that is substantially symmetrical in rotation), and also because they need to be positioned with substantially greater accuracy if a desired light emission pattern which corresponds to the spread of the elements is to be obtained for the headlight (or some other optical system) with a preset accuracy.

Something else that is often of considerable importance with LED and similar elements is, in particular, the positioning of a so-called light-dark boundary in a plane perpendicular to the optical axis (or for example a longitudinal axis of the vehicle). Generally speaking, this light-dark boundary may not be tilted relative to a characteristic direction perpendicular to the optical axis (i.e. relative to the horizon or to a transverse axis of the vehicle) and must be maintained at a fixed distance from the optical axis.

It is therefore an object of the invention to provide a light-source module of the kind specified in the opening paragraph with which, as part of an optical system such as, in particular, a headlight, a desired light emission patterns can be obtained with substantially greater accuracy or with a substantially lower tolerance than with known light-source modules such as in particular LED modules.

The intention is also to provide a light-source module of the kind specified in the opening paragraph that can be inserted in an optical system, such as in particular a headlight, and removed therefrom, relatively easily.

With the invention, the intention is further to provide a light-source module of the kind specified in the opening paragraph with which a reliable electrical and mechanical connection to an optical system can be ensured without soldered, welded, bonded or similar connections having to be made for the purpose.

Finally, the intention is also to provide a light-source module of the kind specified in the opening paragraph with which reliable and adequate dissipation of the heat emitted by the light sources can be ensured, particularly when the module has a plurality of light-emitting elements.

This object is achieved, with a light-source module for an optical system, having at least one light exit area that is of a shape and/or an extent in a plane that is selected to correspond to a light emission pattern to be obtained with an optical system in which the module can be inserted, the module having at least one reference point that can be used to position the light exit area in a predetermined position as a result of the module resting against the optical system.

The object is also achieved with a holder for the insertion of a light-source module that has at least one supporting face for the at least one reference point of the module.

Particular advantages of these solutions are on the one hand that a reference system is created by which a defined interface is made available between the optical areas of the module and of the system and hence, at the same time, a correcting system comes into being with which it becomes possible for the light-emitting elements (or the module) to be positioned or aligned relative to the optical system (or the reference plane thereof).

The light exit area may be formed not only by one or more suitably arranged LEDs but also by lens elements, light-exit regions of fiber optics or other light guides, or mirror elements or other light sources or light-emitting elements. Something that may also be used is, in particular, a light exit aperture of a collimator structure that collects and focuses the light from one or more LEDs. In this case, the edge of such an exit aperture may preferably serve to produce a light-dark boundary in the light emission pattern of the optical system in which the module is inserted (i.e. in for example a plane perpendicular to the optical axis of the optical system or, if required, to a longitudinal axis of the vehicle if the two are not the same).

Embodiments of the invention are also suitable in particular for motor vehicle headlights in which the beam of light emitted is intended to have a light-dark boundary in, for example, a plane perpendicular to the optical axis of the beam.

Embodiments of the invention provide various arrangements of reference points with which it is possible for the desired positions of the module, and hence for example of the path followed by a light-dark boundary relative to the optical axis of an optical system and, if required, relative to a transverse axis of the vehicle that is generally perpendicular to the latter axis, to be obtained with particular accuracy.

Embodiments of the invention make it possible for electrical contact to be made with the module in a particular simple way when the module is provided with light-emitting elements.

Embodiments of the invention are advantageous especially when the light-emitting elements have a relatively high output power.

With embodiments of the invention, it is possible for the light exit area to be positioned or aligned relative to the reference points of the light-source module in an advantageous manner.

Embodiments of invention have the advantage that a light-source module can be inserted or replaced easily without the need for any soldering, welding, bonding or similar connecting techniques.

Embodiments of the invention provide means for the mechanical locking in place of a module inserted in the holder.

These and other aspects of the invention are apparent from and will be elucidated with reference to the embodiments described hereinafter.

The embodiments described below are suitable in particular for use in headlights of motor vehicles or other optical systems in which on the one hand (to avoid dazzle for example) the shape and position of the light beam emitted in a plane perpendicular to the optical axis of the optical system (or, where required, to a longitudinal axis of the vehicle, where the two are not the same), and hence the position of the module relative to the optical axis, have to be very accurately maintained. On the other hand, the module is easily replaceable and a reliable electrical and mechanical connection to the optical system is ensured, even when there is relatively severe vibration, without soldered, bonded or welded connections being required.

In place of the LED elements described, use may also be made of other light-emitting elements (such as, for example, collimator apertures, lens elements, fiber optics, mirror elements, and so on) as light exit areas, in which case the at least one source producing the light (e.g. the LED) then need not necessarily be arranged on the module.

Figure 1:
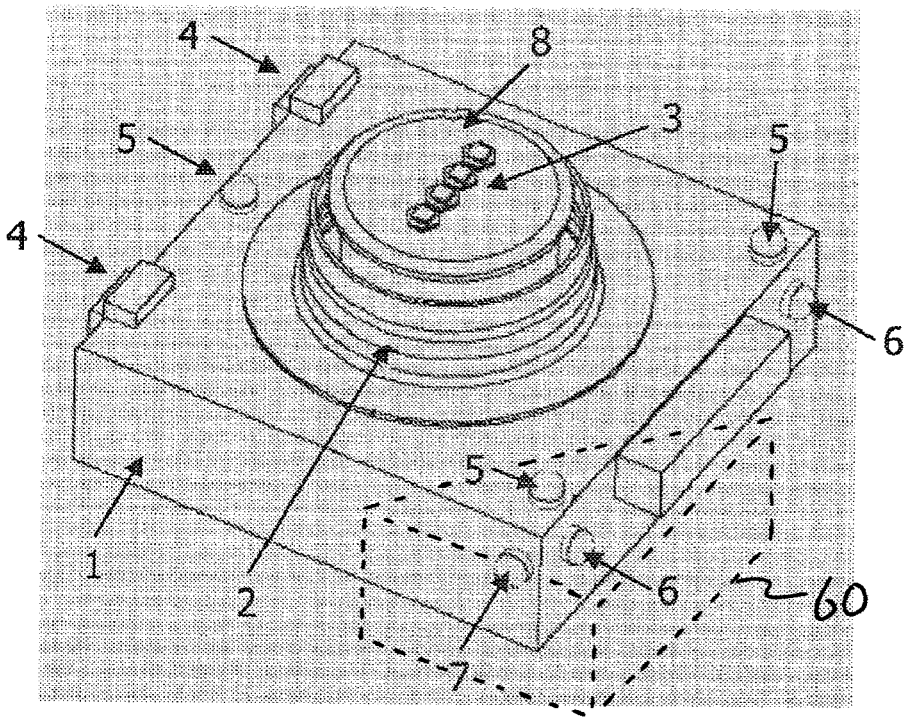
FIG. 1 is a perspective view showing a first embodiment of an LED module.

FIG. 1 is a perspective view showing a first embodiment of an LED module according to the invention. The LED module comprises a substantially cuboid carrier 1 in which is inset a body 2, of cylindrical shape in the case shown, which is made of a material having high thermal conductivity. The body 2 is preferably composed of a metal such as copper for example and is substantially solid. The body 2 has an end-face 8 in which are inserted a plurality of LED elements 3, the heat emitted by these latter being dissipated by means of the body 2. For this purpose, the body 2 is thermally connected to a suitable heat-sink (not shown) on the rear side of the carrier 1.

Electrical contact is made with the LED elements 3 via first contacts 4 that are so arranged at the edge of the carrier 1 that, when the LED module is inserted in a holder belonging to the optical system, shown by dashed lines 60, they make contact with corresponding mating contacts.

Together, the LED elements 3 form a light exit area of the body 2, with the shape and/or extent of the light exit area being selected to suit the light emission pattern (and particularly the distribution of brightness in the plane perpendicular to the optical axis) that is to be obtained with an optical system in which the module can be inserted.

For use in motor vehicle headlights for example, it is a requirement that, to avoid dazzling oncoming traffic, the light beam is substantially rectangular in the plane perpendicular to the longitudinal axis of the vehicle, or at least has a boundary line (light-dark boundary) that extends substantially horizontally and/or is curved and/or is provided with steps.

For this purpose, the LED elements 3 are arranged along a line whose path corresponds to the path followed by the boundary line, in the said plane, of the light beam emitted, which line (as well as other optical elements) plays a substantial part in producing this boundary line or light emission pattern.

For a light emission pattern of this kind (or some other light emission pattern) to be obtained, and for a correct position or direction to be obtained for it, it is particularly important for the LED module to occupy a defined position or location in the optical system, i.e. relative for example to a secondary optical element such as a lens or a reflector, and to do so permanently and with the greatest possible accuracy.

For this purpose, there is preferably defined in the optical system a reference plane, perpendicular to the optical axis of the optical system, in relation to which the module is positioned. It will also be assumed that the optical axis of the optical system extends perpendicularly to the plane in which the light exit area of the module lies.

For the positioning of the module relative to the reference plane or the optical axis, use is made of three first reference points 5 that are arranged on what is, in the view shown in FIG. 1, the top face of the carrier 1 and by which the module rests against corresponding mating surfaces belonging to the holder of the optical system. In this way, the module is aligned or positioned relative to the said reference plane, i.e. by displacing it in a direction perpendicular to the latter (i.e. by displacing it in the direction in which the optical axis lies) and/or by tilting it relative to the reference plane (or relative to the optical axis).

With these first reference points 5, there is thus created a reference system between the optical face of the module and the optical face of the optical system in which the module is inserted, thus enabling the optical properties of the optical system to be sized in relation to the module.

Situated on a first side-face of the carrier 1 are two second reference points 6 by which the module likewise rests against the holder and with which the module can be positioned in a defined way by tilting it relative to a first axis perpendicular to the optical axis and/or, in particular, by displacing it in a first direction perpendicular to the optical axis, i.e. in the present case in relation to the position and path of the said boundary line (light-dark boundary) of the light beam emitted by the optical system. The second reference points 6 thus make exact positioning possible relative to the direction of the longitudinal axis of the vehicle. They also make it possible for the distance between the boundary line and the optical axis to be exactly maintained.

Finally, there is situated on a second side-face a third reference point 7 by which the module rests against the holder and with which a defined position is determined for the module by tilting it relative to a second axis perpendicular to the optical axis and/or by displacing it in a second direction relative to the optical axis, i.e. in the present case relative to the lateral position of the boundary line in the latter's lengthwise direction.

The reference points 5, 6, 7 are made from a suitable material such as, for example, hard rubber, plastics material or metal and are fastened to the carrier 1 or are part thereof. Exact positioning of the light exit area, i.e. of the LED elements 3, relative to the reference points 5, 6, 7 can be accomplished by adjusting the thickness (retrospectively if required) of the reference points 5, 6, 7 by machining them or working on them in some other way.

As an alternative, or in addition, the body 2 carrying the LED elements 3 may also be mounted on the carrier 1 in such a way that the LED elements 3 can be positioned or aligned relative to the reference points 5, 6, 7 by displacing or turning the body 2 in relation to the carrier 1.

Figure 2:
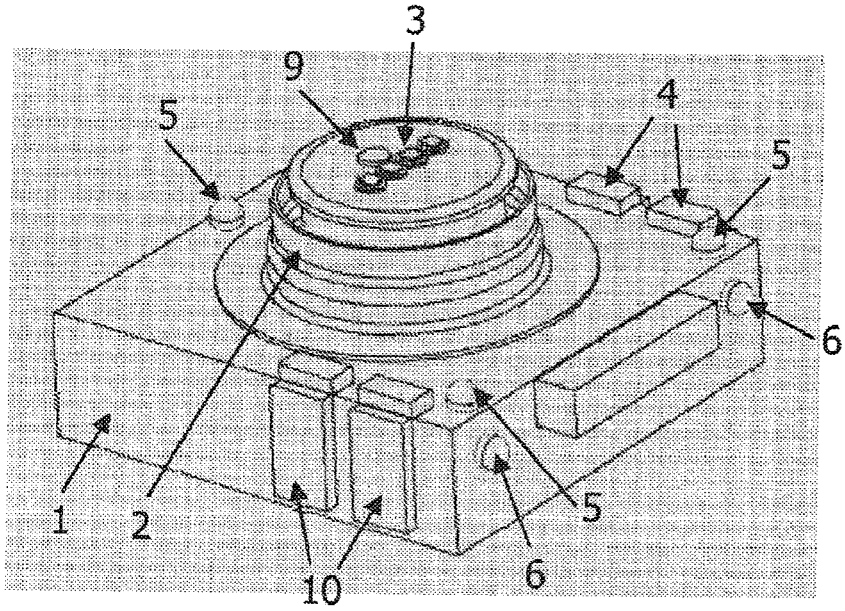
FIG. 2 is a perspective view showing a second embodiment of an LED module.

FIG. 2 shows a second embodiment of the present LED module. Parts that are the same as in FIG. 1 are each identified by the same reference numerals in this case. In contrast to FIG. 1, the second embodiment has a temperature sensor 9 that is inserted in the body 2 next to the row of LED elements 3. To allow electrical contact to be made with the temperature sensor 9, there are provided at the edge of the carrier 1 two second contacts 10, while the LED elements 3 can be connected to a current source via first contacts 4.

The temperature sensor 9 can be connected to an external electronic unit or one incorporated in the module or the optical system via two contact s 10, in order for example to enable the light output of the LED elements to be reduced when a given limiting value of temperature is reached.

In both embodiments, the first and second contacts 4, 10 are of a form such that they exert only minimal forces in the directions that are critical with regard to the light emission pattern of the optical system (the directions substantially perpendicular to the reference plane and the boundary line).

The contacts 4, 10 may also be of a form such they exert or strengthen an elastic force by which the LED module is pressed into the correct position or location in the optical system.

Figure 3:
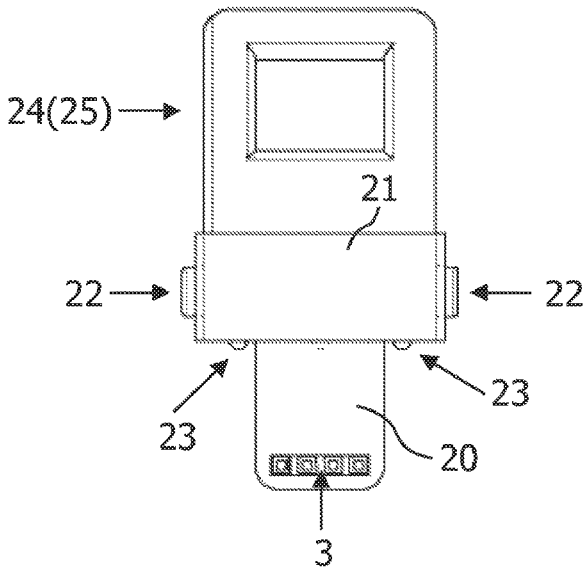
FIG. 3 is a front view showing a third embodiment of an LED module.
Figure 4:
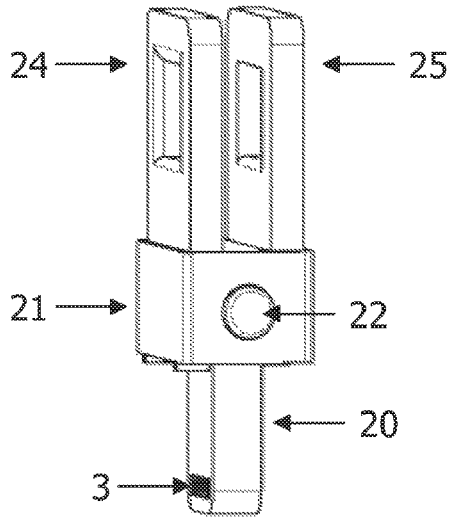
FIG. 4 is a side view of the LED module shown in FIG. 3.
Figure 5:
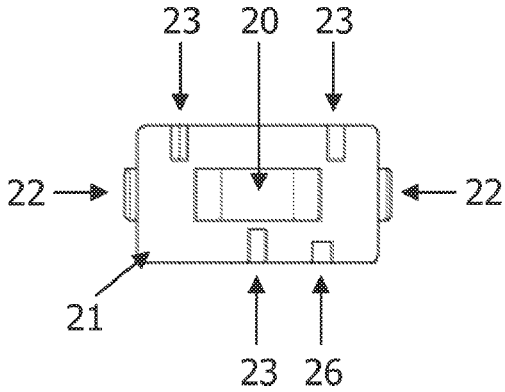
FIG. 5 is a view from below of the LED module shown in FIG. 3.

FIGS. 3 to 5 are different views of a third embodiment of an LED module according to the invention. Parts that are the same are identified by the same reference numerals in each of these three Figures.

This module has a substantially rectangular body 20 made of a material of high thermal conductivity, at one of whose ends a row of LED elements 3, which together form a light exit area, is once again arranged. The body 20 is fastened by its other end to a first longitudinal side of a carrier 21 made of an electrically non-conductive material such as in particular plastics material.

To enable the heat generated by the LED elements 3 to be dissipated, and to allow the LED module to be handled, there are mounted on the opposite, second longitudinal side of the carrier 21 two finger-hold members 24, 25 which are in thermal connection with the body 20 and are made from a material having good thermal conductivity.

To allow power to be supplied to the LED elements 3, there is situated on each of the two narrow sides of the carrier 21 a contact 22 that, when the module in inserted in a holder, makes electrical contact with a corresponding mating contact.

Particularly in the view from below of the LED module that is shown in FIG. 5, it can clearly be seen that on the (bottom) first longitudinal side of the carrier 21 there are three reference points 23 each of which is in the form of a projection and which once again serve to rest against a mating surface belonging to a holder and to allow the module or light exit area to be positioned relative to a reference plane of the optical system concerned. Between the two finger-hold members 24, 25, an elastic force can be exerted on the carrier 21, to press the module against the mating surface.

Finally, there may be situated on the first longitudinal side of the carrier 21 a marking 26 that takes the form of for example a recess in the carrier 21, in which, when the module is inserted in a holder, a corresponding projection on the holder engages. In this way, it can be ensured that the correct module is being inserted in the holder in the correct orientation.

Figure 6:
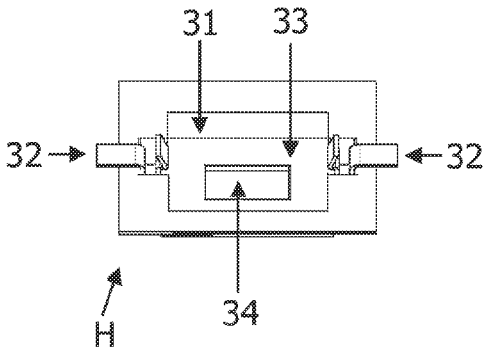
FIG. 6 is a plan view of a first embodiment of holder for an LED module.
Figure 7:
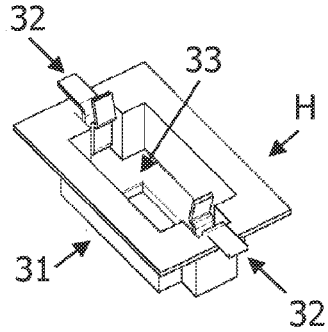
FIG. 7 is a perspective view of the holder shown in FIG. 6.

FIGS. 6 and 7 are schematic views of a first embodiment of holder H for an LED module as shown in FIGS. 3 to 5. Parts that are the same are identified by the same reference numerals in each of these Figures.

This holder H comprises, in essence, a bathtub-like member having a depression 31 whose inside dimensions match the outside dimensions of the carrier 21 and which has a floor face 33.

Situated in said floor face 33 is an opening 34 through which the body 20 extends when the carrier 21 of the module is inserted in the depression 31. When the carrier 21 is so inserted, its reference points 23 rest against the regions of the floor face 33 that surround the opening 34.

The holder H also has mating contacts 32 that make electrical contact with the contacts 22 of the module when the latter is inserted.

Figure 8:
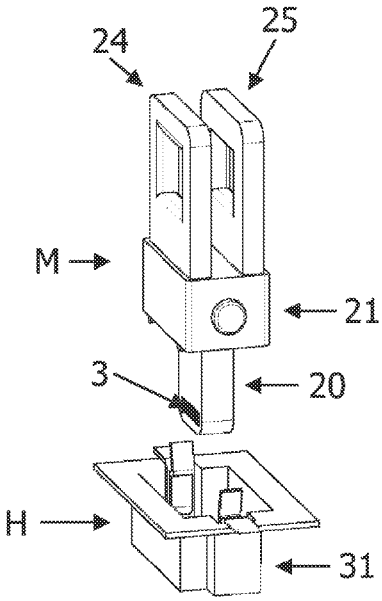
FIG. 8 shows the LED module of FIG. 3 and the holder of FIG. 6 before they are fitted together.
Figure 9:
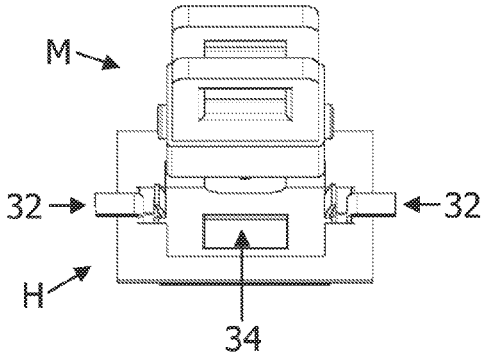
FIG. 9 shows the LED module of FIG. 3 and the holder of FIG. 6 while they are being fitted together.
Figure 10:
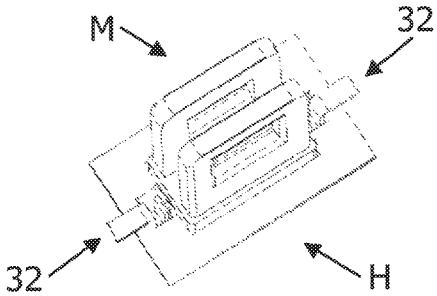
FIG. 10 shows the LED module of FIG. 3 and the holder of FIG. 6 in the fitted-together state.

FIGS. 8 and 9 show how the LED module M is inserted in the holder H, and in FIG. 10 the two parts are shown in the fitted-together state. It is clear from these views that the LED module M can be inserted in the holder H by being guided in one direction, and hence relatively easily, with a defined position or location for the module M relative to a reference plane of the optical system being obtained at the same time by means of the reference points 23.

To ensure that the module M can be locked securely and reliably in place in the holder H, the mating contacts 32 are designed to be resilient, so that they make a latching or snap connection with the contacts 22 on the carrier 21, by which connection the module M is pressed against the floor face 33 of the holder H by its reference points 23.

Figure 11:
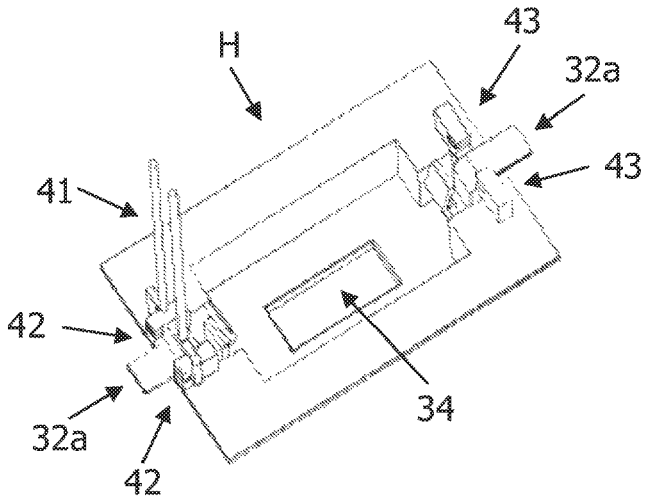
FIG. 11 is a perspective view of a second embodiment of holder for an LED module.

FIG. 11 shows a second embodiment of holder H for an LED module M as shown in FIGS. 3 to 5. This holder H too comprises a substantially bathtub-like member having mating contacts 32*a* for a module M and a depression 31 that has a floor face 33 having an opening 34.

In contrast to the first embodiment shown in FIGS. 6 and 7, in the second embodiment the LED module that is inserted is pressed against the reference plane by means of a clip 41, which means that the latter assumes the function for this purpose that is performed by the resilient mating contacts 32 in the first embodiment of holder H.

Figure 12:
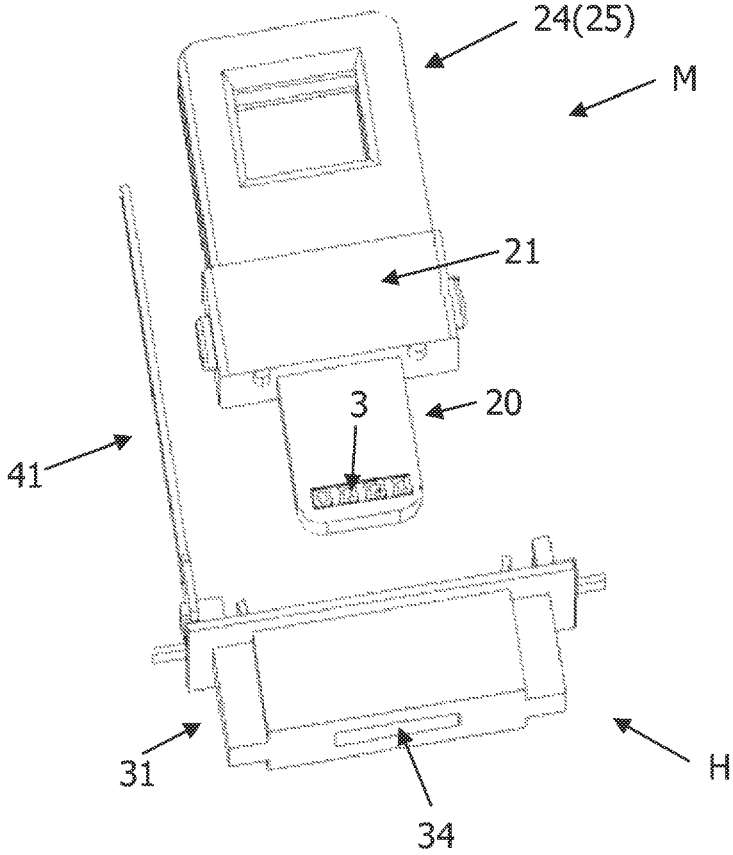
FIG. 12 shows the LED module of FIG. 3 and the holder of FIG. 11 before they are fitted together.
Figure 13:
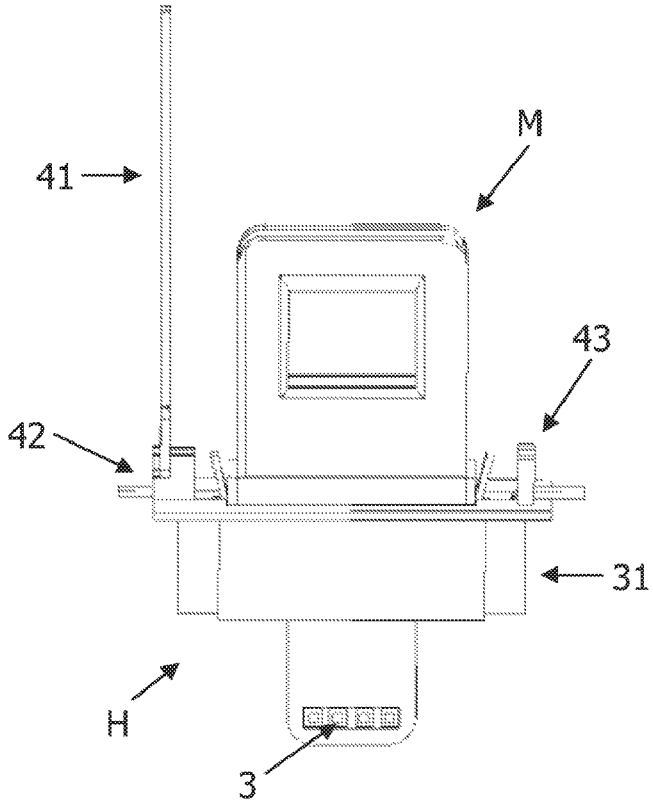
FIG. 13 shows the LED module of FIG. 3 and the holder of FIG. 11, with the LED module inserted.

By a first end, the clip 41 is mounted to pivot in a mounting 42 on the holder H and in FIGS. 11, 12 and 13 it is shown in the open position, in which the module M can be inserted in the holder H, as shown in FIG. 12.

Figure 14A:
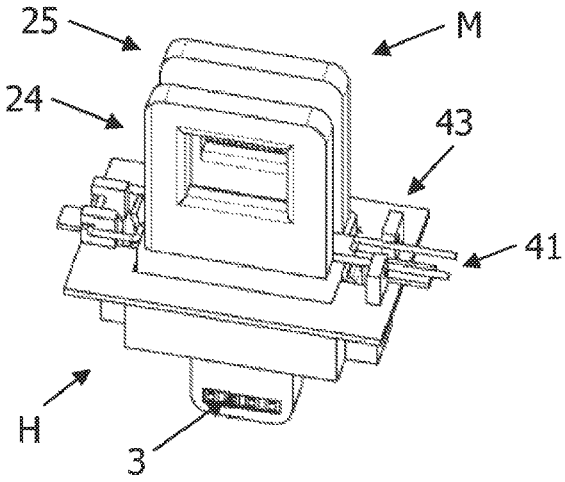
FIG. 14 shows the LED module of FIG. 3 and the holder of FIG. 11 in the locked state.
Figure 14B:
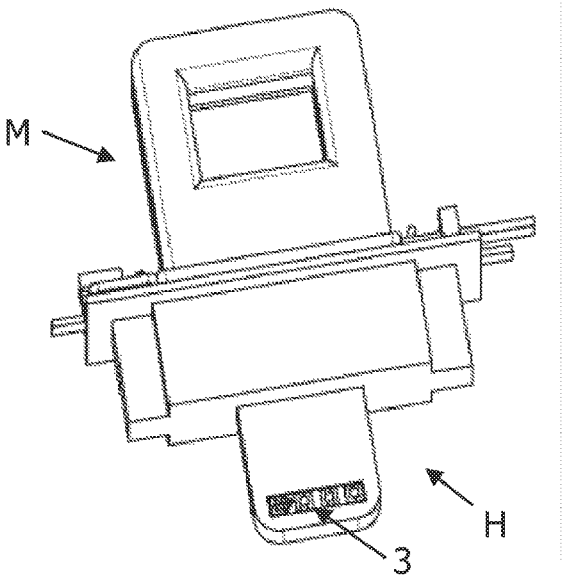

FIG. 13 shows the module M in the inserted state before the clip 41 is closed, whereas (A) and (B) of FIG. 14 are perspective views of the module M inserted in the holder H after the clip 41 has been closed.

As is clear from FIG. 14(A), the second end of the clip 41 is locked to a latch means 43 on the holder H in the closed state.

The clip 41 is preferably formed from two portions of wire that, after the clip is closed, bear resiliently against the carrier 21 between the two finger-hold members 24, 25 and thereby press the LED module M into the holder H or in other words against the reference plane.

The latch means 43 may for example comprise two parts which each have a recess in the form of an indentation, into each of which indentations one of the portions of wire is resiliently inserted to close the clip 41, once the portions of wire have been compressed and pivoted down between the two parts.

In this embodiment too, the mechanical locking in place of the LED module M, and the making of electrical contact therewith, are accomplished by the module being guided into the holder H in one direction.

The second embodiment of holder is advantageous particularly in applications in which the module and the holder are exposed to severe vibration.

Figure 15:
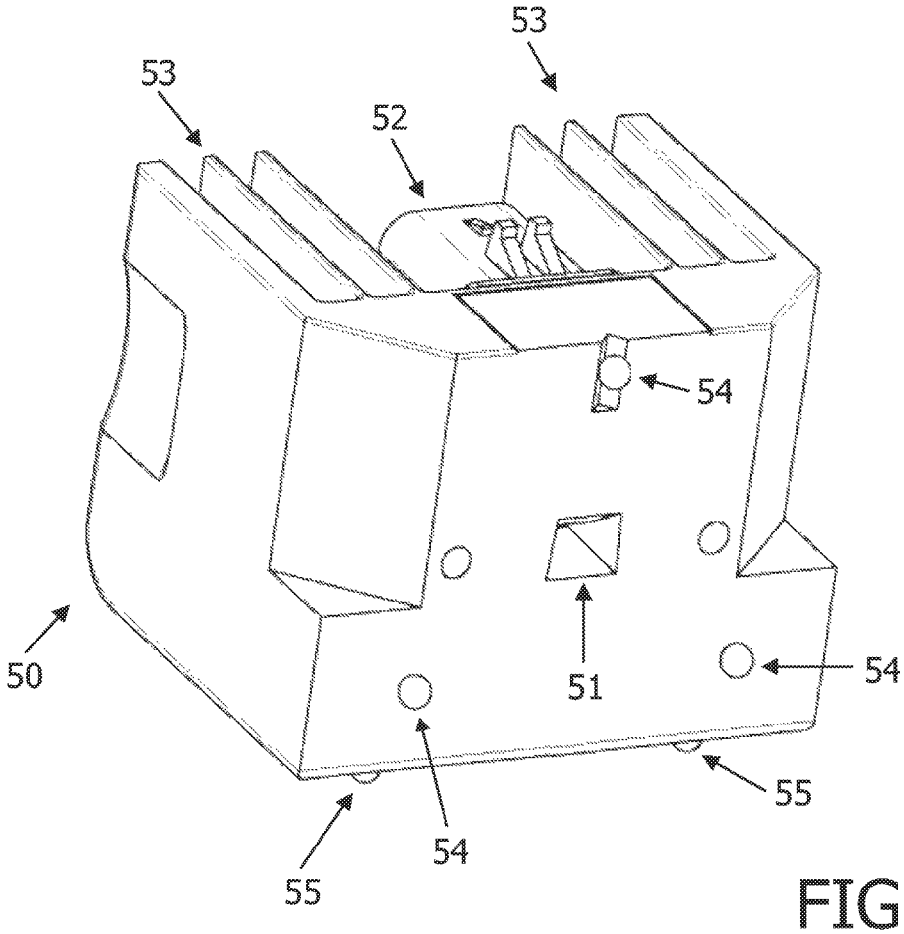
FIG. 15 is a perspective view of a fourth embodiment of an LED module.
Figure 16:
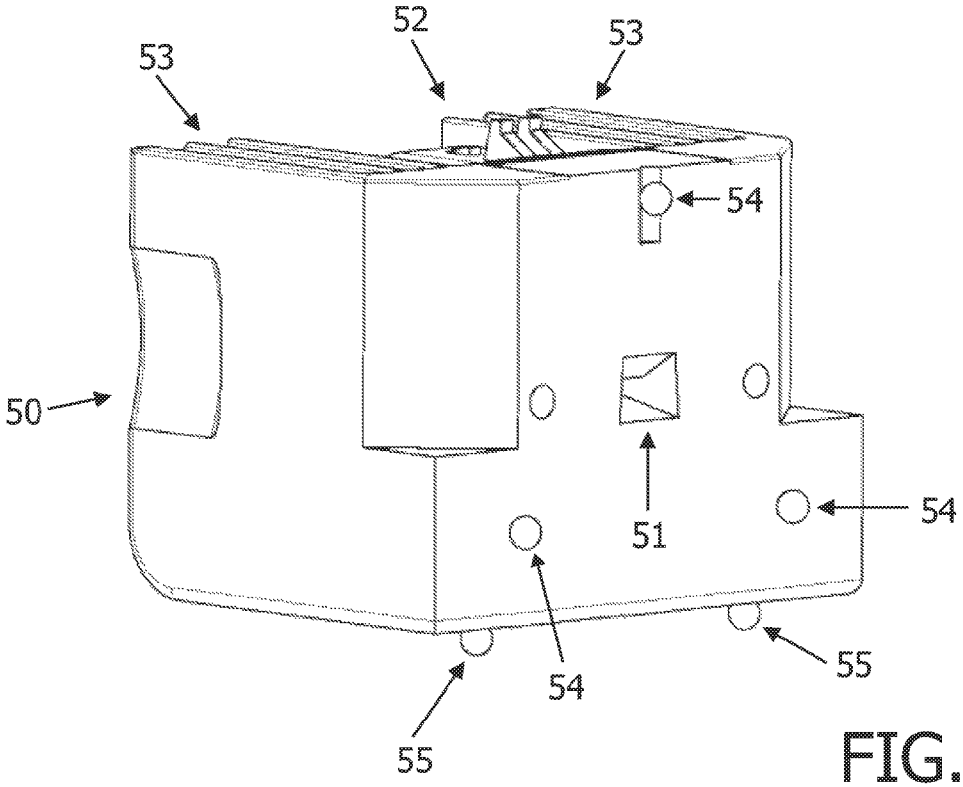
FIG. 16 is a further perspective view of the LED module shown in FIG. 15.
Figure 17:
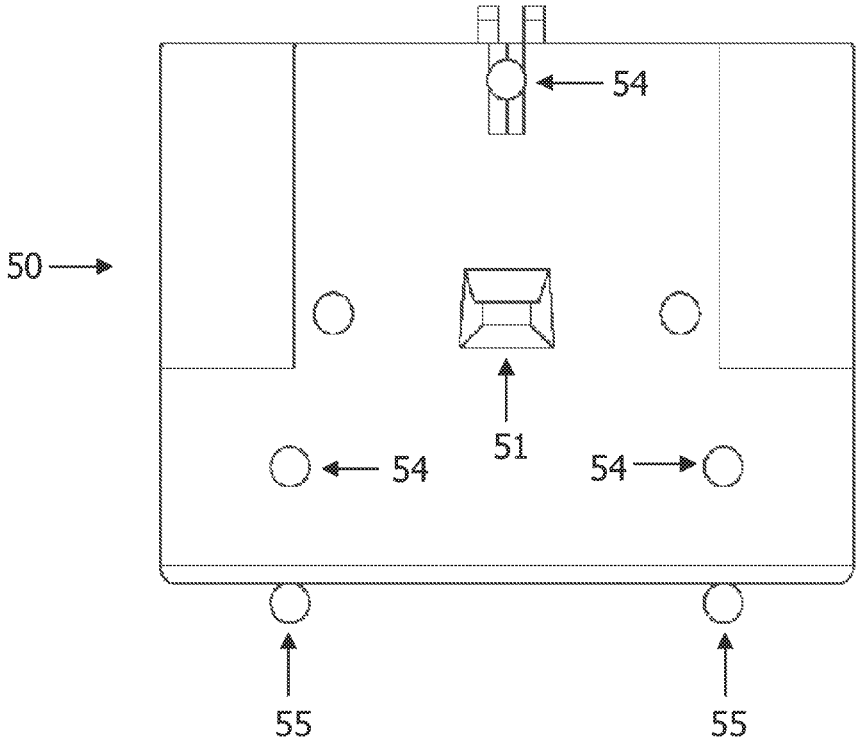
FIG. 17 is a first side view of the LED module shown in FIG. 15.
Figure 18:
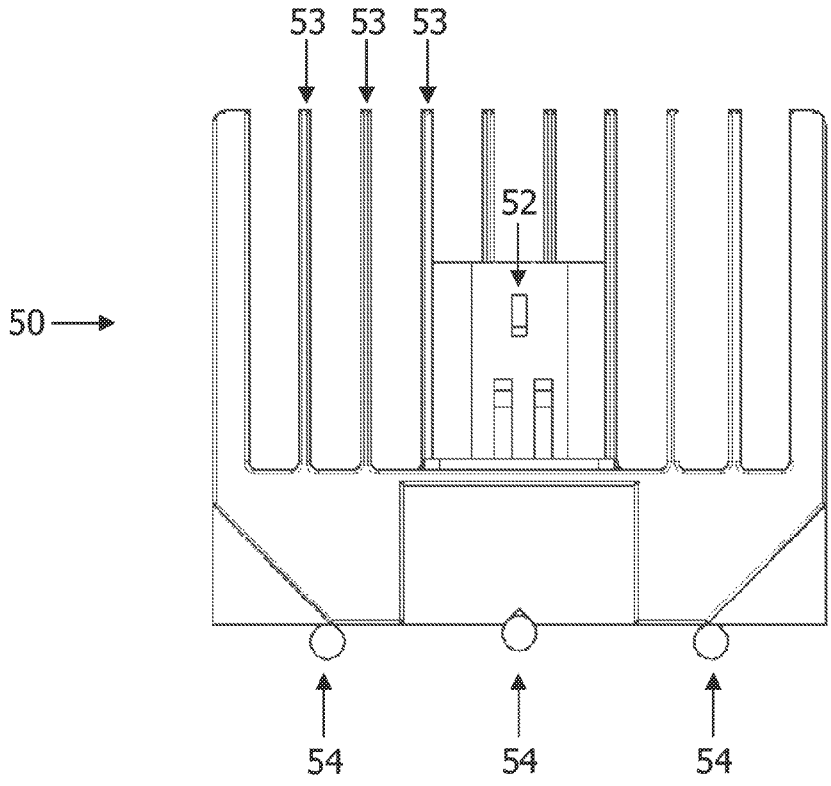
FIG. 18 is a second side view of the LED module shown in FIG. 15.

FIGS. 15 to 18 show a fourth embodiment of an LED module according to the invention, FIGS. 15 and 16 being perspective views of the module and FIGS. 17 and 18 being side views thereof.

The LED module has a substantially cuboid carrier 50 having a first side-face in which a light exit area 51 is situated. As is clear from FIG. 17 in particular, the light exit area 51 is substantially rectangular in shape, in which case at least one edge of the said area can be used to produce a light-dark boundary in the light emission pattern of the optical system concerned. The light exit area 51 is produced by for example a correspondingly rectangular opening in the first side-face, in which is situated a light source such as, for example, an LED, a collimator aperture or the end of a light guide. A lens element of the same shape as the opening is preferably placed over this light source.

Also situated on the first side-face are three first reference points 54 by which the carrier 50 rests against a corresponding mating surface belonging to an optical system. In this way, in a similar way to what is done by the first reference points 5 in the case of the first embodiment shown in FIGS. 1 and 2, the module is aligned or positioned relative to a reference plane of the optical system, i.e. by displacing it in the direction in which the optical axis of the optical system lies and/or by tilting it relative to the optical axis of the optical system.

As can be seen from FIGS. 15, 16 and 17, there are situated on a second side-face of the carrier 50 two second reference points 55 by which, in a similar way to what is done by the second reference points 6 in the case of the first embodiment shown in FIGS. 1 and 2, the module is aligned or positioned by displacing it in a direction perpendicular to the optical axis and/or by tilting it relative to an axis perpendicular to the optical axis of the optical system.

The reference points 54, 55 are once again made from a suitable material such as, for example, hard rubber, plastics material or metal and are fastened to the carrier 50 or are a part thereof. Exact positioning of the light exit area relative to the reference points 54, 55 can be accomplished by adjusting the thickness (retrospectively if required) of the reference points 54, 55 by machining them or working on them in some other way.

Finally, as can be seen in FIG. 18, the carrier 50 also has a connector 52 for connecting up an electrical or optical cable, and cooling fins 53 by which the heat generated by the light sources is dissipated.

The invention claimed is:

1. A light-source module for an optical system comprising:

a carrier having at least two carrier surfaces having at least two sets of reference points in at least two different directions for positioning the carrier in a predetermined position against at least two system surfaces of the optical system;

a light source coupled to one of the at least two carrier surfaces; and a body and a light exit window arranged on the body, wherein the body is at least one of rotatable and displaceable relative to the carrier to at least one of position and alignment of the light exit window relative to the at least two sets of reference points.

2. The light-source module as claimed in claim 1, wherein a first set of the two sets includes a number of first reference points for at least one of displacing the module in a direction an optical axis of the optical system lies and tilting the module relative to the optical axis.

3. The light-source module as claimed in claim 2, wherein a second set of the two sets includes a number of second and third reference points for at least one of tilting the module relative to a perpendicular axis which is perpendicular to the optical axis and displacing the module along the perpendicular axis.

4. The light-source module as claimed in claim 1, further comprising contacts for the making electrical contact with the light source, wherein the contacts make contact with mating contacts on a holder when the module is inserted in the holder.

5. The light-source module as claimed in claim 4, further comprising a body having high thermal conductivity and being mounted on the carrier, wherein the light source is inserted in the body.

6. The light-source module of claim 1, wherein the positioning of the carrier is determined by adjusting a thickness of the at least two sets of reference points.

7. An optical system comprising:

a light source;

a light-source module for holding the light source and including at least one light exit window, wherein the light source produces a light emission pattern from the light exit window; and a holder for holding the light-source module;

wherein the module comprises at least two reference points in at least two different directions for positioning the light exit window in a predetermined position when the module rests against the holder; wherein the module further comprises a further reference point in a third direction, the two different directions and the third direction being orthogonal to each other, wherein the two reference points and the further reference point are for resting on three orthogonal surfaces of the holder, and wherein the module is a cuboid having three module orthogonal surfaces for being adjacent to the three orthogonal surfaces of the holder when the module is inserted in the holder.

8. The optical system of claim 7, wherein the two different directions are orthogonal to each other for resting the two reference points on two orthogonal surfaces of the holder of the light-source module.

9. A light-source module for an optical system comprising:

a carrier having a first surface, a second surface and a third surface; and a light source coupled to the first surface;

wherein the carrier includes a first reference point on the first surface, a second reference point on the second surface, and a third reference point on the third surface for positioning the carrier on the optical system; and wherein the first reference point, the second reference point and the third reference point are pointed in three different directions.

10. The light-source module of claim 9, wherein the three different directions are orthogonal to each other.

11. The light-source module of claim 9, wherein the positioning is adjusted by adjusting a thickness of at least one the first reference point, the second reference point and the third reference point.

* * * * *